United States Patent [19]

Harshbarger

[11] 4,364,103

[45] Dec. 14, 1982

[54] BATTERY CASE FOR AN ELECTRICALLY OPERATED DEVICE

[76] Inventor: Thad L. Harshbarger, 4991 Northlawn Dr., Murrysville, Pa. 15668

[21] Appl. No.: 176,647

[22] Filed: Aug. 11, 1980

[51] Int. Cl.[3] ..... F21L 9/00

[52] U.S. Cl. ..... 362/200

[58] Field of Search ..... 354/126; 362/200, 201, 362/205, 157

[56] References Cited

U.S. PATENT DOCUMENTS

| | | | |
|---|---|---|---|
| 626,627 | 6/1899 | Middlekauff | 362/157 |
| 1,148,839 | 8/1915 | Harnack | 362/205 X |
| 1,969,196 | 8/1934 | Barber et al. | 240/10.65 |
| 2,082,676 | 6/1937 | Beiler | 362/200 X |
| 2,550,234 | 4/1951 | Duncan | 362/205 X |
| 2,703,385 | 3/1955 | Curd | 362/205 X |
| 2,853,832 | 9/1958 | Arena | 362/200 X |
| 2,867,753 | 1/1959 | Quandt | 317/91 |
| 2,966,538 | 12/1960 | Bernot | 136/111 |
| 3,563,805 | 2/1971 | Deierhoi | 429/152 |
| 3,617,387 | 11/1971 | Grulke et al. | 429/162 |
| 3,622,771 | 11/1971 | Franc | 240/2 |
| 3,629,793 | 12/1971 | Ettischer et al. | 354/126 X |
| 3,734,780 | 5/1973 | Bilhorn et al. | 429/162 |
| 3,770,504 | 11/1973 | Bergum | 429/152 |
| 3,780,504 | 12/1973 | Haseloff | 56/13.6 |
| 3,899,670 | 8/1975 | Delfortrie | 240/10.65 |
| 4,042,760 | 8/1977 | Land | 429/162 |
| 4,124,742 | 11/1978 | Land et al. | 429/122 |
| 4,181,778 | 1/1980 | Land | 429/53 |

FOREIGN PATENT DOCUMENTS

| | | | |
|---|---|---|---|
| 2448864 | 4/1976 | Fed. Rep. of Germany | 362/200 |

*Primary Examiner*—Donald A. Griffin

*Attorney, Agent, or Firm*—Stanley J. Price, Jr.; John M. Adams

[57] ABSTRACT

A battery housing is formed by a pair of side walls, a top wall and a bottom wall. One end of the battery housing is closed and an opposite end is open. The housing forms a compartment adapted to receive through the open end portion a multicelled planar battery of the type employed in a cassette film pack conventionally used in a self developing photographic camera. A pair of electrically conductive leaf spring terminals are secured to the battery housing top wall. Each of the leaf spring terminals has a first contact end portion positioned within the compartment and a second contact end portion projecting out of the compartment. A sliding switch is mounted on the battery housing. Electrical leads connect the leaf spring terminals to an electrically operated device and the switch. The electrically operated device has a voltage rating which corresponds to the voltage of the multicelled planar battery, for example, six volts. In a preferred embodiment, the electrically operated device is a light bulb mounted in the socket of a lens. The switch is operable between a first position and a second position to open and close the circuit and thereby illuminate the light bulb when desired for use as a flashlight. With this arrangement a cassette film pack is reusable after its use in a photographic camera as an energy source.

11 Claims, 13 Drawing Figures

BATTERY CASE FOR AN ELECTRICALLY OPERATED DEVICE

BACKGROUND OF THE INVENTION

1. Field of the Invention

This invention relates to a battery case for an electrically operated device and more particularly to a battery case having a light bulb mounted thereon and constructed to receive a consumed cassette film pack of a photographic camera which provides the electrical energy to illuminate the light bulb mounted on the battery case thereby employable as a flashlight.

2. Description of the Prior Art

U.S. Pat. Nos. 3,563,805; 3,617,387; 3,734,780; disclose planar energy cells or batteries intended for use as an individual power source for portable electrically operated devices. The multicelled planar batteries are employed commercially to operate photographic cameras such as the camera sold by Polaroid Corporation, Cambridge, Mass. under the trademark "SX-70".

When used in a photographic camera, the multicelled planar battery is housed within a cassette or film pack. The cassette houses both the planar battery and a number of film units for selective sequential exposure. The multicelled planar battery provides the electrical energy necessary to operate the camera's exposure control, film transport, and photoflash systems.

U.S. Pat. No. 4,181,778 dicloses a multicelled planar battery that is housed within a film pack cassette. The battery is a "wafer-thin" battery constructed with individual battery cells in superimposed or stacked configuration and in electrical series relationship. The number of stacked cells is determined by the power output of each cell and the power requirements of the device to be energized by the battery.

The battery ordinarily comprises a LeClanche electrochemical system that includes a zinc negative anode system and a manganese dioxide positive or cathode system as disclosed in U.S. Pat. No. 3,770,504. The multicelled battery is positioned within the cassette so that the electrical leads of the battery are exposed at the terminal ports of the cassette and engage the electrical leads of the camera. A spring platform is positioned between the planar battery and the stack of individual film units. Generally ten film units are provided in each film pack. Each film unit is individually and sequentially ejected from a passage through one end of the cassette.

One of the primary features of the cassette film pack is the electrical power capacity of each of the battery cells comprising the multicelled unit. Each cell is operable to produce about 0.10 to 0.15 ampres per square inch of surface area while yielding 1.5 volts. With this arrangement, the battery has a capacity for a film supply-power source having a considerable storage life necessitated by the fact that the film pack may be maintained in storage for sometime before it is used.

It is the customary practice to discard the above described cassette film pack after the individual film units have been exposed by operation of the camera being powered by the multicelled planar battery. Because the battery has a considerable storage life, the power capacity of the multicelled planar battery is not consumed in operating the camera to expose the individual film units and power the other camera instrumentalities. Therefore, the multicelled planar battery has considerable reserve power remaining after the film units have been exposed. This reserve power is otherwise wasted when the multicelled planar battery is discarded with the expended film pack. Therefore, there is need to provide an apparatus that utilizes the reserve power of an expended photographic film pack in the practice of energy conservation.

SUMMARY OF THE INVENTION

In accordance with the present invention, there is provided a battery case for an electrically operated device that includes a battery housing having a pair of side walls, a top wall, a bottom wall, and at least one open end portion. The battery housing forms a low profile battery compartment of a preselected configuration as defined by the side walls and the top and bottom walls. The battery compartment is accessible through the one open end portion. A pair of electrically conductive terminal strips are secured to the top wall. Each of the terminal strips has a first contact end portion selectively positioned within the battery compartment and a second contact end portion projecting from the top wall externally of the battery compartment. A switch is mounted on the upper surface of the top wall. Conductor means electrically connects the terminal strips to an electrically operated device in a circuit. The conductor means is connected to the switch with the switch being operable between a first position and a second position to open and close the circuit.

Further in accordance with the present invention, there is provided a flashlight that includes a battery housing having a pair of side walls, a top wall, a bottom wall, and at least one open end portion. The battery housing forms a rectangularly shaped compartment adapted to receive a multicelled planar battery. The battery compartment is accessible through the one open end portion for the insertion and removal of the multicelled planar battery. A pair of leaf spring terminals are secured to the top wall. Each of the leaf spring terminals has a first contact end portion selectively positioned in the battery compartment and a second contact end portion projecting from the top wall externally of the battery compartment. The first contact end portions are urged downwardly from the top wall into the battery compartment to make electrical contact with the multicelled planar battery and simultaneously retain the multicelled planar battery in the battery compartment. A switch is mounted on the top surface of the top wall. An electric light bulb is mounted on the upper surface of the top wall. Conductor means electrically connect the leaf spring terminals to the electric light bulb in a circuit. The conductor means are connected to the switch. The switch is operable between a first position and a second position to open and close the circuit between the electric light bulb and the multicelled planar battery.

Preferably, the multicelled planar battery is of the type employed in photographic cameras such as those sold by Polaroid Corporation under the trademark "SX-70". When the film units of the cassette film pack are exposed, the film pack has completed its use in the camera. It is the conventional practice to then discard the consumed film pack. The film pack contains a multicelled planar battery of the LeClanche type.

After the planar battery in the film pack has been employed to operate the various electrically powered photographic systems of the photographic camera, the planar battery has substantial residual power that is adaptable for use in accordance with the present invention to power an electrically operated device, such as a light bulb for use with the novel battery housing as a flashlight. The planar battery when installed in the battery compartment, provides a six volt source that is capable of powering a light bulb for a considerable period of time after the film pack has fulfilled its primary use in a photographic camera.

The multicelled planar battery includes a pair of spaced apart electrical leads. The planar battery is positioned in the cassette film pack with the individual film units to be exposed. The cassette includes a pair of ports that are aligned with the electrical leads of the battery so as to expose the electrical leads of the planar battery. When in use in a photographic camera, the electrical leads of the planar battery engage the electrical leads of the camera. Thus, in the present invention, the first contact end portions of the leaf spring terminals are positioned to engage the corresponding exposed electrical leads of the planar battery.

In one embodiment of the present invention, the battery housing has a compartment of the configuration adapted to receive the cassette as it is removed from a photographic camera after the individual film units have been exposed. The cassette is easily inserted and removed from the battery housing compartment. In this manner, after the energy of the planar battery is consumed, the cassette is easily removed from the compartment and a replacement cassette is inserted.

In another embodiment, the multicelled planar battery is removed from the cassette after its use in a photographic camera and is positioned in the battery housing compartment. The battery housing compartment thus has a reduced height to receive the individual planar battery when removed from the cassette. The planar battery is inserted through the compartment open end portion and is advanced to a position in the compartment where the end of the battery abuts the back end wall of the compartment. In this position in the compartment the electrical leads of the battery are in contact with the first contact end portions of the leaf spring terminals.

Accordingly, the principal object of the present invention is to provide a battery case for an electrically operated device that utilizes the multicelled planar battery of a cassette film pack employed in self-developing photographic cameras thereby providing a secondary use for an available energy source which would otherwise be discarded after its primary use in ejecting exposed film units in a camera.

Another object of the present invention is to provide a battery case having a battery compartment adapted to receive a multicelled planar battery employed in film packs of photographic cameras and to connect the planar battery through a circuit mounted on the case to an electrically operated device, such as a light bulb, for use in powering the electrical device and thereby provide a secondary use of an energy source after its primary use has been fulfilled.

A further object of the present invention is to provide a flashlight that includes a light bulb mounted on a battery housing having an opening to receive the expended cassette film pack of a photographic camera and a pair of leaf spring terminals supported in the housing to engage the exposed electrical leads of a multicelled planar battery positioned in the cassette to thereby complete an electrical circuit through a switch to the light bulb for illumination of the light bulb by operation of a switch to open and close the circuit to the multicelled planar battery.

These and other objects of the present invention will be more completely disclosed and described in the following specification, the accompanying drawings, and the appended claims.

DESCRIPTION OF THE PREFERRED EMBODIMENTS

Figure 1:
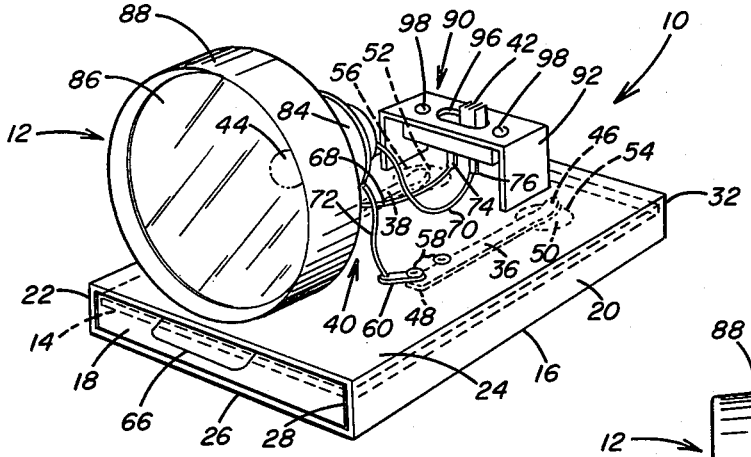
FIG. 1 is a perspective view of a battery case for an electrically operated device, illustrating an expended cassette film pack having a multicelled planar battery positioned in the battery case for supplying electrical power to the electrically operated device, such as a light bulb.
Figure 2:
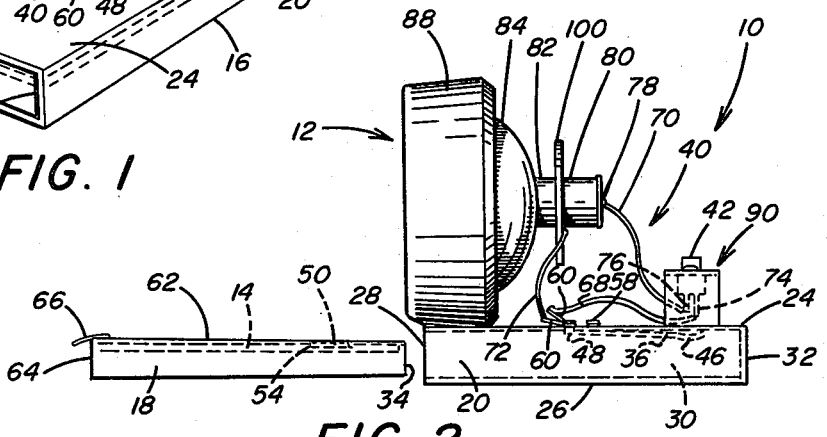
FIG. 2 is a view in side elevation of the battery case shown in FIG. 1, illustrating the film pack opposite the opening into a compartment of the housing and a pair of leaf spring terminals positioned in the compartment.

Referring to the drawings, and particularly to FIGS. 1–6, there is illustrated a battery case generally designated by the numeral 10 for supporting an electrically operated device generally designated by the numeral 12 in electrical contact with a multicelled planar battery 14 within a housing 16 of the battery case 10. The multicelled planar battery 14 is of the type conventionally employed in photographic cameras of the type sold by Polaroid Corporation under the trademark "SX-70" for providing the electrical energy necessary to operate the camera's exposure control, film transport, and photoflash systems. When used to operate a photographic camera, the multicelled planar battery 14 is housed within a disposable cassette film pack 18, as shown in FIGS. 1 and 2.

In use with a photographic camera, the cassette retains a predetermined number of film units for selective sequential photoexposure and the multicelled planar battery. This arrangement is disclosed in U.S. Pat. No. 3,543,662. It is the conventional practice to discard the cassette film pack together with the enclosed multicelled planar battery after all the film units have been exposed and expended from the cassette. The present invention utilizes the expended cassette containing the multicelled planar battery which contains considerable residual electrical power after it has fulfilled its primary use and is thereafter operable in a secondary use as an energy cell.

Figure 7:
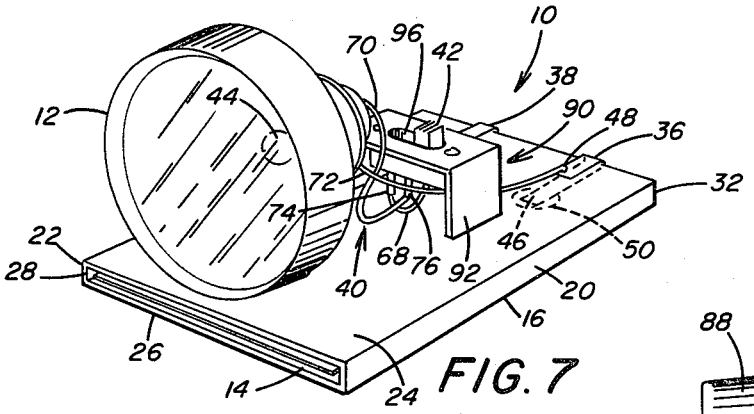
FIG. 7 is a perspective view of a second embodiment of a battery case similar to the case shown in FIG. 1, illustrating a battery case adapted to receive a multicelled planar battery removed from an expended cassette film pack.

The cassette housing 16 has a pair of side walls 20 and 22, a top wall 24, a bottom wall 26, and an open end portion 28 into a battery compartment 30 formed by the housing 16. The compartment 30 has a low profile and has a preselected configuration for receiving the expended cassette film pack 18 as it is removed from a photographic camera following its primary use. Most preferably, the battery housing 16 and the compartment 30 formed thereby are rectangularly shaped in conformance with the rectangular shape of the cassette 18. As illustrated in FIG. 7, and described hereinafter in greater detail, the battery housing 16 may be constructed to receive the multicelled planar battery 14 removed from the cassette 18. In the second embodiment, the vertical dimension and profile of the housing 16 are reduced to receive the multicelled planar battery 14 which has been removed from the cassette 18.

Now referring in greater detail to FIGS. 1–6, the battery housing 16 has a closed end portion 32 positioned oppositely of the open end portion 28. With this arrangement, the cassette 18 is easily inserted into the compartment 30 and removed from the compartment 30. The closed end portion 32 serves as an abutment means for receiving the cassette 18. The cassette 18 is advanced through the housing open end portion 28 and into the compartment 30 until a leading edge 34 of the cassette 18 abuts against the housing closed end portion 32. In this position the cassette 18 is operatively positioned within the compartment 30 for electrical contact with a pair of electrically conductive terminal strips 36 and 38 which are secured to the housing top wall 24.

The terminal strips 36 and 38 are connected in a circuit generally designated by the numeral 40 through a sliding-type switch 42 to the electrically operated device 12 that includes, for example, a light bulb 44. By operation of the sliding switch 42 from a closed circuit position to an open circuit position electrical energy is supplied by the multicelled planar battery 14 within the film cassette 18 through the circuit 40 to the light bulb 44. The light bulb 44 is iluminated and thus the housing 16, cassette 18, and light bulb 44 are operable as a flashlight or an emergency electrical torch.

Preferably each of the terminal strips 36 and 38 are leaf spring-like conductors having a first end contact portion 46 and a second contact end portion 48. The first contact end portion 46 is selectively positioned within the battery compartment 30, and the second contact portion 48 projects from the top wall 24 externally of the battery compartment 30. The multicelled planar battery 14 includes a pair of electrical leads 50 and 52. The cassette 18 includes a pair of terminal ports 54 and 56. The electrical leads 50 and 52 are exposed at the terminal ports 54 and 56. The electrical leads 50 and 52 are connected to the anode and cathode of the planar battery 14.

Preferably, the battery 14 comprises one or more planar electrical energy cells in series relationship. Each energy cell includes superposed planar anode and cathode elements having disposed between their facing surfaces a separator possessing an electrolyte permeable central portion surrounded by substantially electrolyte-free marginal portions positioned between the anode and cathode. The plurality of energy cells are retained within an electrically nonconducting, preferably impervious sealant. An envelope surrounds the sealant.

A multicelled planar battery of the above type is disclosed in the U.S. Pat. No. 4,181,778 which is incorporated herein by reference. The composition of the battery is beyond the scope of the present invention and will not be discussed herein in detail. A battery of this type is commercially available with the cassette film pack sold by Polaroid Corporation for photographic cameras marketed under the trademark "SX-70". However, it should also be understood in accordance with the present invention that other planar batteries that utilize the LeChanche electrochemical system are also adaptable for use in the present invention.

To accommodate use of an expended "SX-70" film pack, the terminal strip first contact end portions 46 are positioned in the compartment 30 and spaced a preselected distance apart to engage the exposed electrical leads 50 and 52 of the battery 14. The terminal strip second contact end portions 48 are secured to the housing top wall 24 by electrically conductive fasteners 58. The fasteners 58 extend through the second contact end portions 48 and the top wall 24. The opposite ends of the fasteners 58 are expanded to engage at one end the bottom of the terminal strips 36 and 38 and at the opposite end the top surface of the top wall 24.

Conductive tabs 60 surround in electrical contact the portions of the fasteners 58 that extend above the top wall 24. The conductive tabs 60 are connected in a conventional manner in the circuit 40 to the switch 42 and the electrically operated device 12. With this arrangement the terminal strip second contact end portions 48 are secured to the top wall 24 for movement of the first contact end portions 46 toward and away from the top wall 24. Thus, with the terminal strips 36 and 38 being leaf springs the first contact end portions 46 are biased away from the top wall downardly into the compartment 30. This assures engagement of the terminal strip first contact end portion 46 with the electrical leads 50 and 52 of the battery 14 in the cassette 18.

As illustrated in FIG. 2, the cassette 18 has a downwardly sloping upper surface 62 with the exposed electrical leads 50 and 52 being positioned adjacent the leading edge 34. A trailing edge 64 of the cassette 18 is provided with a tab 66 which serves to facilitate insertion and removal of the cassette 18 into and out of the compartment 30. As illustrated in FIG. 1, the tab 66 projects out of the compartment open end portion 28.

By downwardly biasing the terminal strips 36 and 38 from the top wall 24 the first contact end portions 46 are assured of engaging the exposed electrical leads 50 and 52 on the downwardly sloping upper surface 62 of cassette 18. Also engagement of the terminal strips 36 and 38 with the exposed electrical leads 50 and 52 maintains the cassette 18 securely within the housing 16. By selectively positioning the first contact end portions 46 a preselected distance from the housing closed end portion 32, engagement of the contact first end portions 46 with the electrical leads 50 and 52 is assured when the cassette leading edge 34 is abutting the housing closed end portion 32.

Figure 3:
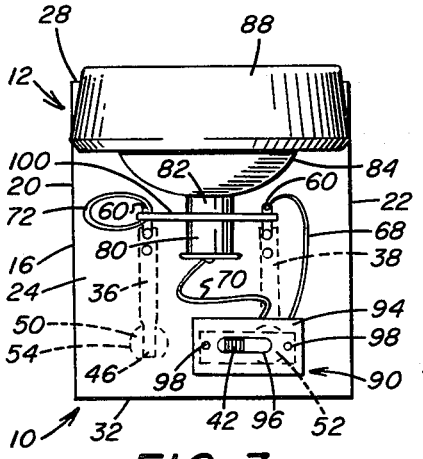
FIG. 3 is a top plan view of the battery case shown in FIG. 1, illustrating a sliding switch for connecting the planar battery through electrical leads to the light bulb.
Figure 4:
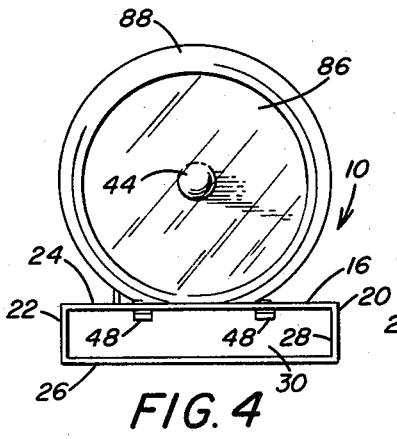
FIG. 4 is a front view of the battery case shown in FIG. 1 with the film pack removed from the compartment, illustrating the open end portion into the compartment.
Figure 5:
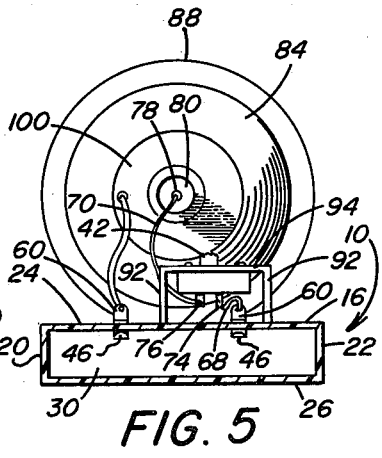
FIG. 5 is a rear view of the battery case partially in section, illustrating the connection of the leafs spring terminals through the electrical leads and the sliding switch to the light bulb.
Figure 6:
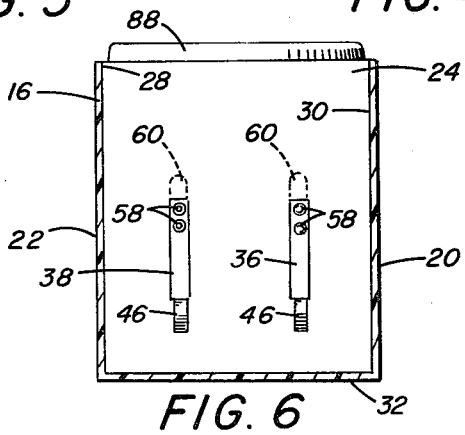
FIG. 6 is a bottom view partially in section of the battery case, illustrating the leaf spring terminals positioned in the battery compartment.

The electrical circuit 40 connecting the multicelled planar battery 14 to the sliding switch 42 and the electrically operated device 12 includes a first conductor 68, a second conductor 70, and a third conductor 72. As illustrated in FIGS. 2, 3, and 5, the first conductor 68 extends at one end portion from the conductive tab 60 of the terminal strip 38 to a contact 74 of the switch 42 at the opposite end portion. The second conductor 70 is connected at one end portion to a second contact 76 of the switch 42 to a contact terminal 78 of the electrically operated device 12 at the opposite end portion.

With the embodiment of the present invention illustrated in FIGS. 1–5 the contact terminal 78 extends from the light bulb 44. The light bulb 44 is positioned within an insulated cap 80 that is releasably engagable in a socket 82 of a reflector 84. The light bulb contact terminal 78 extends through the cap 80 for connection to the end of the second conductor 70. A lens 86 encloses the opening into the reflector 84 and is retained in place on the reflector 84 by a circular lens frame 88. The lens frame 88 is, in turn, securely attached, as by bonding, to the upper surface of the housing wall 24. With this arrangement the lens frame 86 is immovably positioned on the housing 16 so as to form an integral part of the housing 16 for use with the housing 16 as a flashlight or torch. The multicelled planar battery 14 contained within the cassette 18 provides the electrical power for illuminating the light bulb 44 of the flashlight by operation of the sliding switch 42.

The sliding switch 42 is supported on the housing 16 by a bracket generally designated by the numeral 90. The bracket 90 includes a pair of legs 92 secured to and extending upwardly from the housing top wall 24. The legs 92 are connected by a bridging member 94 having a slot 96 for receiving the switch 42. The switch 42 is secured to the bridging member 94 by screws 98. The contacts 74 and 76 extend downwardly from the switch 42 between the legs 92. To complete the circuit between the multicelled planar battery 14 and the electrically operated device 12, the third conductor 72 is connected at one end portion to the conductive tab 60 extending from the second contact end portion 48 of the terminal strip 36. The opposite end of the third conductor 72 is electrically connected to a metallic flange 100 that extends radially around the end of the socket 82.

With this arrangement, when the switch 42 is moved laterally in the slot 96 from the closed circuit position as illustrated in the drawings to an open circuit position, the switch contacts 74 and 76 come into electrical contact with the battery 14 to light up the bulb 44. It has been found after the multicelled planar battery 14 has been used to operate the various electrically powered photographic systems of a photographic camera that the battery 14 contains considerable stored electrical power. Sufficient power is available for operating a 6 volt electrical device, such as the light bulb 44, for a considerable period of time. Thus, an otherwise wasted energy source is conserved to deliver power in a secondary use following its primary use of operating the instrumentalities of a photographic camera.

Figure 8:
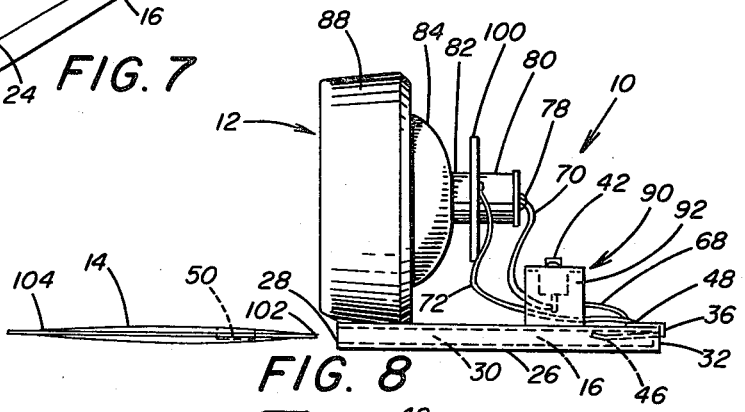
FIG. 8 is a view in side elevation of the battery case shown in FIG. 7, illustrating the planar battery in position for insertion into the battery housing compartment.

Now referring to FIGS. 6–10 there is illustrated a further embodiment of the present invention in which like parts of FIGS. 1–6 are indicated by like numerals in FIGS. 7–10. The battery case 10 in FIGS. 7–10 is sized to receive the multicelled planar battery 14, as illustrated in FIG. 8, after it has been removed from the cassette 18. As discussed above, the multicelled planar battery 14 comprises one or more individual cells, each of which include a planar anode superposed substantially coextensive with a planar cathode. A planar separator is positioned between the anode and the cathode. The multicelled planar battery 14 illustrated in FIG. 8 is described in detail in U.S. Pat. No. 4,181,778.

The open end portion 28 of the housing 16 is dimensioned to receive a leading edge 102 of the battery 14. When in position within the housing 16 a trailing edge 104 of the battery extends outwardly from the housing open end portion 28 to facilitate removal of the battery 14 from the housing 16. As discussed above for the cassette 18 containing a battery, the battery 14 illustrated in FIGS. 8–10 includes a pair of electrical leads 50 and 52. The electrical leads are engagable with the first contact end portions 46 of the spring biased terminal strips 36 and 38.

Figure 9:
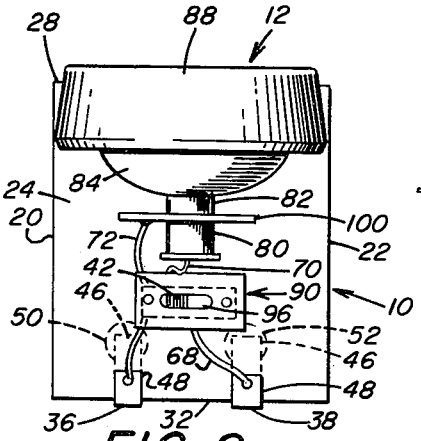
FIG. 9 is a top plan view of the battery case shown in FIG. 7.
Figure 10:
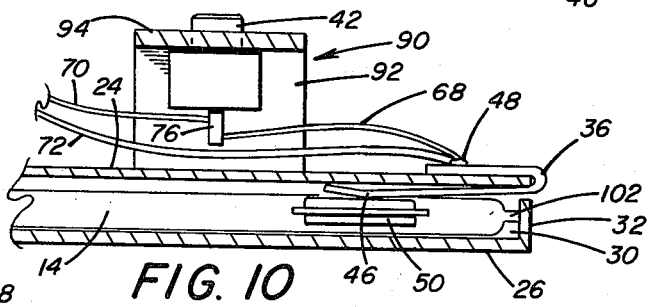
FIG. 10 is an enlarged, fragmentary sectional view of the battery case shown in FIG. 7, illustrating electrical contact of one of the leaf spring terminals with the electrical lead of the multicelled planar battery.

As illustrated in FIG. 10 the housing top and bottom walls 24 and 26 are spaced a preselected distance apart to receive the "wafer-thin" battery so that the downwardly biased contacts 46 engage the exposed electrical leads 50 and 52, illustrated in phantom in FIG. 9. It should be understood that other commercially available planar batteries for portable electrically operated devices are adaptable for use with the battery case 10 of the present invention. Batteries that employ the aforementioned LeClanche electrochemical system are particularly adaptable.

As further illustrated in FIG. 10, the terminal strip 36 as well as the terminal strip 38 which is not shown in FIG. 10, extends from the first contact end portion 46 in underlying relation with the lower surface of the top wall 24 and around the end of the top wall 24 and out of the compartment 30 to the second contact end portions 48. The second contact end portion 48 is secured to the upper surface of the top wall 24. As above described, the second contact end portion 48 of the terminal strip 38 is electrically connected by the first conductor 68 to contact 74 of the switch 42. The second contact end portion 48 of the terminal strip 36 is connected by the third conductor 72 to the metallic flange 100 of the light bulb socket 82. Also as shown in FIG. 8, the contact 76 of the switch 42 is connected by the second conductor 70 to the contact terminal 78 of the light bulb 44.

Thus by sliding the switch 42 from the close circuit position in the slot 96 laterally to the open circuit position the light bulb 44 is turned on. As with the embodiment of the present invention illustrated in FIG. 1 for the embodiment illustrated in FIGS. 7–9 the first contact end portions 46 of the terminal strips 36 and 38 are positioned to receive the electrical leads 50 and 52 of the "wafer-thin" battery 14 when the leading edge 102 is abutting the housing closed end portion 32. This assures that when the battery 14 is completely inserted in the housing 16, as illustrated in FIGS. 9 and 10, the battery electrical leads 50 and 52 engage the terminal strips 36 and 38.

The battery case 10 of the present invention is operable to convert the multicelled planar battery of a photographic cassette film pack after primary use in a photographic camera to a secondary use in powering an electrically operated device having a voltage rating corresponding to the voltage rating of the battery in the cassette. The aforementioned commercially available battery that is utilized for powering the instrumentalities of a photographic camera is power rated at 6 volts. Therefore, with the embodiment of the present invention illustrated in FIG. 7, any 6 volt rated electrical device can be connected to the circuit 40.

Figure 11:
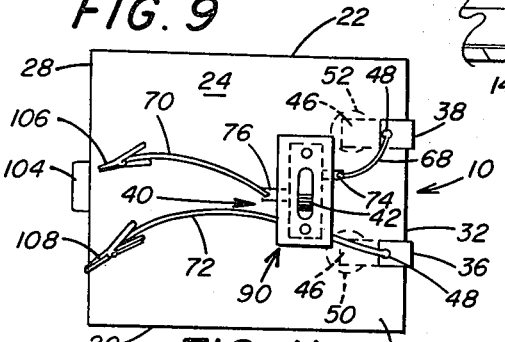
FIG. 11 is a top plan view of a further embodiment of the battery case of the present invention, illustrating electrical leads extending from the switch for connection to a selected electrically operated device.

The circuit 40 shown in the FIG. 11 embodiment includes the above described arrangement. However, the conductors 70 and 72 are provided with clip on end portions 106 and 108 that are adaptable for connection to the terminals of an electrical device capable of being powered at the voltage supplied by the battery 14. As with the embodiments illustrated in FIGS. 1 and 7, the embodiment of the battery case 10 in FIG. 11 can be adapted to receive either the film cassette 18 with the planar battery 14 encased in the cassette 18 or the planar battery 14 removed from the cassette 18.

Figure 12:
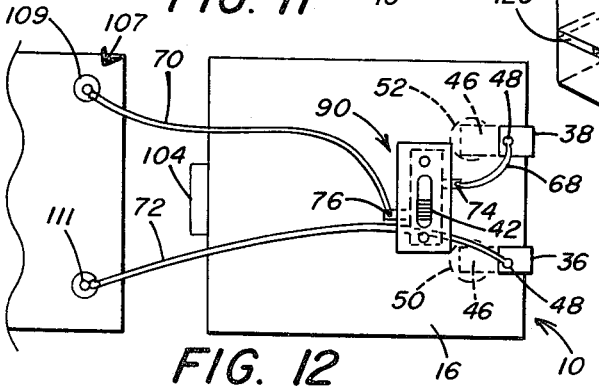
FIG. 12 is a top plan view of a battery case similar to the battery case shown in FIG. 11, illustrating electrical leads extending from the switch to the terminals of an electrically operated device to be powered by the multicelled planar battery.

With this arrangement other electrical devices such as a small motor, radio, horn, toys, or the like can be operated by the combination of the multicelled planar battery from an expended film cassette and the battery case 10. FIG. 12 illustrates the manner in which a selected electrically powered device generally designated by the numeral 107 is powered by the battery case 10. The device 107 has electrical terminals 109 and 111 which are connected to ends of the electrical conductors 70 and 72, above described, extending from the battery case 10. Thus the battery case 10 is adaptable for converting the expended cassette 18 with the battery 14 from its primary use in a camera to a plurality of secondary uses which permit conservation of the stored energy available in the battery 14 after completion of its primary use. Preferably the battery case 10 is fabricated of a resilient plastic material. However, many other materials well known in the art are usable for construction of the battery case 18. In addition to facilitate insertion and removal of either the cassette 18 or the planar battery 14 in the compartment 30, the housing top wall 24 may be hinged to the side walls 20 and 22 or to the closed end portion 32.

Figure 13:
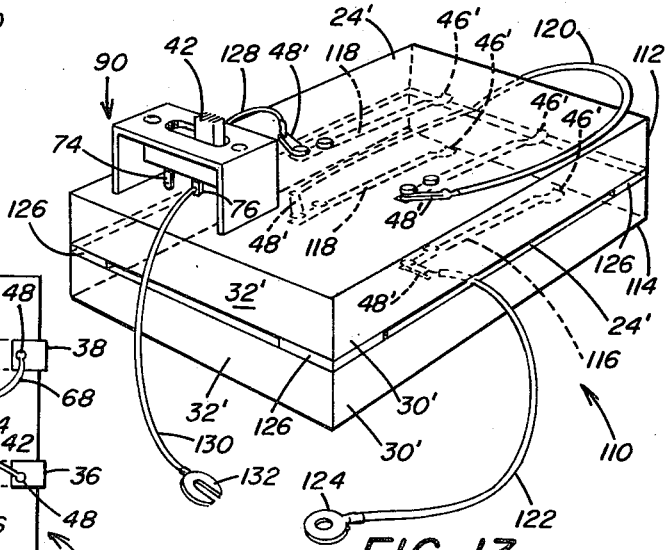
FIG. 13 is a perspective view of a further embodiment of the present invention illustrating a pair of stacked battery cases each having a pair of leaf spring terminals connected in series to use a pair of multicelled planar batteries and thereby expand the voltage output of the battery case.

Not only can a single multicelled planar battery 14 from a single cassette 18 be utilized with the present invention but the battery case 10 can be modified to receive a plurality of cassettes 18 with enclosed batteries 14 or a plurality of batteries 14 alone to expand the power capacity of the battery case. Wilth this arrangement multiples of 6 volts are available as an energy source. FIG. 13 illustrates this aspect of the present invention in which a composite battery case generally designated by the numeral 110 is operable to receive in a stacked, series relationship at least two multicelled planar batteries 14 either in individual cassettes 18 or removed from the cassettes 18.

The composite battery case 110 includes a first housing 112 and a second housing 114 in a stacked arrangement. Each of the housings 112 and 114 includes a pair of leaf spring terminals 116 and 118 secured, as above described for the battery housing 16 of FIGS. 1-6, to the top wall 24' and extending downwardly into the compartment 30' of each housing 112 and 114. Further, each pair of terminal strips 116 and 118 is provided with the first contact end portions 46' engagable with the exposed electrical leads (not shown) of a multicelled planar battery to be inserted in the respective housing compartments 30'.

The series connection is formed by connecting a selected one of the second contact end portions 48' of the first battery housing 112 with one of the second contact end portions 48' of the second battery housing 114 by a conductor 120. The other second contact end portion 48' of the second battery housing 114 is then connected to a conductor 122. The conductor 122 extends from the end portion 48' between the overlying housings 112 and 114. The conductor 122 is provided with a terminal end portion 124 that is adapted for connection to any suitable electrical device, such as the device 107 illustrated in FIG. 12, to be powered by the stacked arrangement of cassettes with planar batteries or planar batteries alone.

As seen in FIG. 13, the first and second housings 112 and 114 are connected to each other by spacers 126. The spacers 126 are positioned at the respective corners of the housings 112 and 114. This arrangement facilitates extension of the conductors 120 and 122 from between the oppositely positioned top and bottom walls of the housings 112 and 114 respectively.

To complete the series connection of the stacked arrangement of battery housings 112 and 114, a conductor 128 is connected to the other second contact end portion 48' of the first housing 112. The conductor 128 is then connected to the contat 74 of the above-described sliding switch 42. The other contact 76 of switch 42 is provided with a conductor 130 having a terminal end portion 132 adapted for connection to a desired electrical device. Thus with the embodiment of the invention illustrated in FIG. 13, multiple expended cassettes 18 with the planar batteries 14 enclosed are utilized for supplying higher voltages which are multiples of the voltage supplied from the battery of a single film cassette. An electrical device having a voltage rating greater than 6 volts can be powered by multiples of a combination cassette and battery with the composite battery case 110 of the present invention.

According to the provisions of the Patent Statutes, I have explained the principle, preferred construction and mode of operation of my invention and have illustrated and described what I now consider to represent its best embodiments. However, it should be understood, within the scope of the appended claims, the invention may be practiced otherwise than as specifically illustrated and described.

I claim:

1. A battery case for an electrically operated device comprising, a battery housing having a pair of side walls, a top wall, a bottom wall, and at least one open end portion, said battery housing forming a low profile battery compartment of a preselected configuration as defined by said side walls and said top and bottom walls, said battery compartment being accessible through said one open end portion, an expended cassette film pack containing a multicelled planar battery of the type employed in self-developing cameras as a power source positioned in said battery compartment, said expended cassette film pack including a housing having terminal ports for exposing electrical leads of said multicelled planar battery, a pair of electrically conductive terminal strips secured to said top wall, each of said terminal strips having a first contact end portion selectively positioned within said battery compartment and a second contact end portion projecting from said top wall externally of said battery compartment, said terminal strips being spring biased to normally urge said first contact end portions downwardly from said top wall to securely make electrical contact with said multicelled planar battery and to securely retain said expended cassette film pack in an operative position within said battery compartment, a switch mounted on the upper surface of said wall, conductor means for electrically connecting said terminal strips to an electrically operated device in a circuit, and said conductor means being connected to said switch with said switch being operable between a first position and a second position to open and close said circuit.

2. A battery case as set forth in claim 1 in which, said battery housing has a rectangularly shaped configuration, and said expended cassette film pack having a rectangularly shaped configuration adapted for positioning in said battery housing.

3. A battery case as set forth in claim 1 in which, said terminal strips are spring biased to urge said first contact end portions downwardly from said top wall into said battery compartment into frictionally engagement with said electrical leads of said multicelled planar battery to securely retain said expended cassette film pack in said battery compartment.

4. A battery case as set forth in claim 1 in which, said terminal strips are pivotally connected at said second contact end portions to said top wall, and said first contact end portions being movable in said battery compartment toward and away from said top wall.

5. A battery case as set forth in claim 1 which includes, said battery housing having an end wall positioned oppositely of said open end poriton, said first contact end portions being positioned a preselected distance from said end wall, and said end wall forming an abutment means to receive and position said multicelled planar battery in electrical contact with said first contact end portions.

6. A battery case as set forth in claim 1 which includes, an electrically operated device securely mounted on said top wall to form with said battery housing a portable electrically operated device.

7. A battery case as set forth in claim 6 which includes, said switch having a pair of terminals, first conductor means for electrically connecting one of said second contact end portions to one of said terminals, second conductor means for electrically connecting the other of said terminals to said electrically operated device, and third conductor means for electrically connecting the other of said second contact end portions to said electrically operated device to complete said circuit between said pair of terminal strips and said electrically operated device with said switch being operable to open and close said circuit to turn said electrically operated device off and on.

8. A battery case as set forth in claim 1 which includes, a second battery housing secured to said first mentioned battery housing in overlying relationship to a composite battery case, said second battery housing having an accessible battery compartment adapted to receive an expended cassette film pack containing a multicelled planar battery, said second battery housing having a pair of electrically conductive terminal strips secured to said top wall within said battery compartment thereof, said battery housing terminal strips each having a first contact end portion and a second contact end portion, and second conductor means for electrically connecting said second battery housing terminal strips to said first mentioned battery housing terminals strips in electrical series relationship.

9. A flashlight comprising, a battery housing having a pair of side walls, a top wall, a bottom wall, and at least one open end portion, said battery housing forming a rectangularly shaped compartment, an expended cassette film pack containing a multicelled planar battery of the type employed in self-developing cameras as a power source positioned in said battery compartment, said expended cassette film pack including a housing having terminal ports for exposing electrical leads of said multicelled planar battery, said battery compartment being accessible through said one open end portion for the insertion and removal of said expended cassette film pack, a pair of leaf spring terminals secured to said top wall, each of said leaf spring terminals having a first contact end portion selectively positioned within said battery compartment and a second contact end portion projecting from said top wall externally of said battery compartment, said first contact end portions being urged downwardly from said top wall into said battery compartment to make electrical contact with said multicelled planar battery and simultaneously retain said expended cassette film pack in said battery compartment, a switch mounted on the top surface of said top wall, an electric light bulb mounted on the upper surface of said top wall, conductor means for electrically connecting said leaf spring terminals to said electric light bulb in a circuit, and said conductor means being connected to said switch with said switch being operable between a first position and a second position to open and close said circuit between said electric light bulb and said multicelled planar battery to turn said electric light bulb off and on.

10. A flashlight as set forth in claim 9 which includes, said leaf spring terminals pivotally connected at said second contact end portions to said top wall to permit movement of said first contact end portions into and out of frictional engagement with said multicelled planar battery to facilitate the insertion and removal of said expended cassette film pack in said battery compartment.

11. A flashlight as set forth in claim 9 which includes, a plurality of said battery housing arranged in a stack, and said conductor means connecting said battery housings to said electric light bulb in electrical series relationship to facilitate use of a plurality of multicelled planar batteries to increase the voltage available to power said electric light bulb.

* * * * *